US005142463A

United States Patent [19]

Panagotacos et al.

[11] Patent Number: 5,142,463

[45] Date of Patent: Aug. 25, 1992

[54] RETRACTABLE LIGHTING SYSTEM

[75] Inventors: George W. Panagotacos, Riverside; Thomas F. Movius, Redondo Beach, both of Calif.

[73] Assignee: Corona Plastics Sales & Service, Inc., Norco, Calif.

[21] Appl. No.: 748,183

[22] Filed: Aug. 14, 1991

[51] Int. Cl.[5] ..... F21V 21/26

[52] U.S. Cl. ..... 362/285; 362/386; 362/364

[58] Field of Search ..... 362/319, 364, 386, 385, 362/285, 236

[56] References Cited

U.S. PATENT DOCUMENTS

| | | | |
|---|---|---|---|
| 4,974,134 | 11/1990 | Bourne | 362/286 |
| 4,984,139 | 1/1991 | Goggia | 362/364 |
| 5,003,441 | 3/1991 | Crowe et al. | 362/285 |
| 5,068,773 | 11/1991 | Toth | 362/286 |

*Primary Examiner*—Carroll B. Dority
*Attorney, Agent, or Firm*—Frederick Gotha

[57] ABSTRACT

A light fixture device and system for extending and retracting a light is set forth which includes a housing having an axis of extension and a carriage which is carried by the housing and adapted for axial movement relative to the housing. A direct current motor is coupled to a drive member for axially extending and retracting the carriage and a two-position limit switch having a directionally reversible actuator responsive to a tripping force and in electrical communication with the motor. The tripping force moves the two position limit switch from a first position to a second position when the carriage is extended and from the second position to the first position when the carriage is retracted. A circuit for extending and retracting the lighting system is comprised of a light detector circuit, a logic circuit, a timer circuit and a driver circuit. The light detector circuit resets the timer circuit and also provides output to the logic circuit to control operation of the driver circuit which contains a relay for changing the polarity of the direct current voltage applied to the motor.

26 Claims, 5 Drawing Sheets

RETRACTABLE LIGHTING SYSTEM

FIELD OF THE INVENTION

This invention relates to a photo-electric cell responsive light system for automatically extending and retracting a light fixture to provide illumination at the onset of darkness and to turn off and retract the light fixture after a selected period of time or at sunrise.

BACKGROUND OF THE INVENTION

Lighting devices for delineating the boundary of certain areas of property for illumination such as on an outdoor path, garage driveway, lawn, or to aesthetically enhance landscaped property whether privately or publicly owned, are generally rigid fixtures extending above ground level with illumination provided by the application of an electrical energy source to a light bulb. Since the fixtures of these lighting devices extend above ground level, the aesthetic impression of such fixtures upon the landscape of the property may be extremely undesirable. Additionally, the above ground exposure of the fixtures subjects them not only to damage by the elements, but also to accidental damage which may result from routine property maintenance or use.

SUMMARY OF THE INVENTION

There is, therefore, provided according to the present invention, a lighting system responsive to a photo-electric cell for extending an extension member containing a light source from a light fixture imbedded in the ground above ground level after the onset of darkness and for retracting the extension member after a specified period of time has elapsed or at sunrise. The present invention is directed to a photo-electric cell responsive lighting system which contains a light fixture having an extension member carried by a carriage member which is mounted for extension and retraction relative to the fixture housing by changing the polarity of the direct current voltage applied to a direct current motor coupled to the carriage member by a threaded drive shaft.

A circuit for extending and retracting the lighting system is comprised of a light detector circuit, a logic circuit, a timer circuit and a driver circuit. The light detector circuit resets the timer circuit and also provides output to the logic circuit to control operation of the driver circuit which contains a relay for changing the polarity of the direct current voltage applied to the motor.

The on and off time of the lighting system is selectively controlled by a single pole, single throw switch in the logic circuit which, when in the open position, permits a low level output from the light detector circuit through NOR gates, such as a model 4001, and though an inverter such as a model 4049 Hex Buffer to a resistor in the driver circuit which turns on a pair of transistors to activate the relay; the relay is in the normally closed position when the system is retracted and the light is off. The relay actuates the double pole contacts and thus supplies power to the motor and permits current flow through a diode causing the light to come on and motor to begin extending the carriage member. A finger trip carried by the carriage member trips a limit switch from the down/stop position to the up/stop position which shuts off the motor and permits the light to remain illuminated when the carriage member is fully extended.

When light strikes the photo-electric cell, the resistance of the cell decreases and the output level of the light detector circuit goes high thereby changing the output of the logic circuit NOR gates and the inverting buffer goes to a high level which in turn turns off the transistors and releases the relay to permit return of the double pole contacts to their normally closed position. With the trip switch in the up/stop position, polarity of the voltage applied to the motor is reversed and the carriage member is retracted into the fixture housing. A second finger trip member carried by the carriage member trips the limit switch to the down/stop position and current flow is interrupted by diodes to the DC motor and the light.

The timer circuit is comprised of a pair of cascaded timers which may be model 4541 timers or the like. When the single pole, single throw switch in the logic circuit is closed the time the light remains extended and on is controlled by the timer circuit and determined by adjustment of a potentiometer. With the switch in the logic circuit closed and the potentiometer adjusted for the length of time desired, the NOR gates and inverters preferably model 4049 hex buffers provide an input to a third inverter buffer to produce an output that activates the transistors which in turn permit the relay to be energized thereby activating the system. The length of time the system remains on is determined by adjustment of the potentiometer and the timer circuit. When the timer circuit equals the length of time set by the potentiometer, an output is provided to the NOR gates which reverse the output of the inverter buffer. The inverter buffer shuts off the transistors and de-energizes the relay allowing it to return to its normally closed position.

Thus, a lighting system is provided which permits an extension member carried by a light fixture to extend automatically above ground level at the onset of darkness. The lighting system contains a controlled electric circuit for extending the extension member for a preselected period of time and then retracting it into a fixture housing which is embedded in the ground.

BRIEF DESCRIPTION OF THE DRAWINGS

These and other features and advantages will become appreciated as the same become better understood with reference to the following specification, claims and drawings wherein:

DETAILED DESCRIPTION

Figure 1:
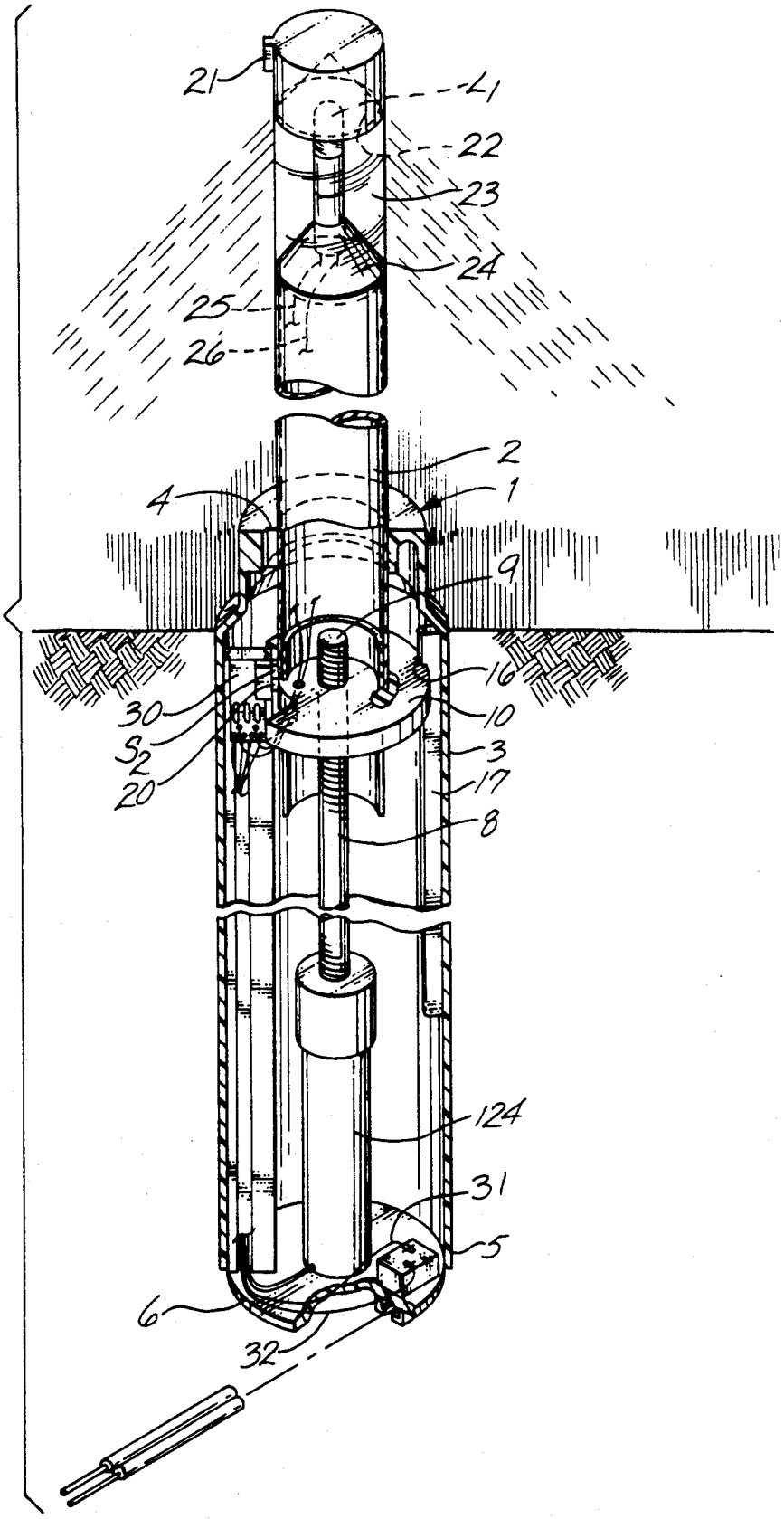
FIG. 1 is a perspective view in partial cross-section of the retractable lighting system of this invention.

Referring to FIG. 1, a perspective view in partial cross-section is shown of the retractable lighting fixture 1 with extension member 2 in the fully extended position above ground level. As shown in FIG. 1, fixture housing 3 is imbedded in the ground with the housing cap 4 extending to approximately the height of the grass level above ground. Fixture housing 3 is preferably made of a plastic material which permits the housing to be injection molded.

The ground imbedded end 5 of housing 3 is bounded by base member 6 which may be integrally formed with the housing or suitably attached to it. A direct current motor 124 is carried by the base 6 of the housing and has a threaded drive member 8 extending from it which is coupled to its drive shaft (not shown). Threaded drive member 8 may be made of a plastic material such as Delrin (a registered trademark of Dupont Co.).

To accomplish the extension and retraction of extension member 2, the distal end 9 of threaded drive member 8 is in threaded engagement with carriage member 10. FIG. 1 depicts the carriage member 10 at its extreme level of travel near the distal end 9 of threaded drive member 8. As can more Clearly be seen in FIG. 2, carriage member 10 is made of a plastic material and has a cylindrical upper extension 11 and a lower cylindrical extension 12 which project from an intermediate cylindrical disc 13 that has a guide slot 16 for receiving an axially extending rib 17 located on the inner wall of the housing. Distal end 9 of threaded drive member 8 is in threaded engagement with internally threaded bore 14 of the cylindrical disc 13. Thus, reversible axial movement of carriage member 10 along extension axis 15 may be accomplished by reversing polarity on the direct current motor.

Figure 2:
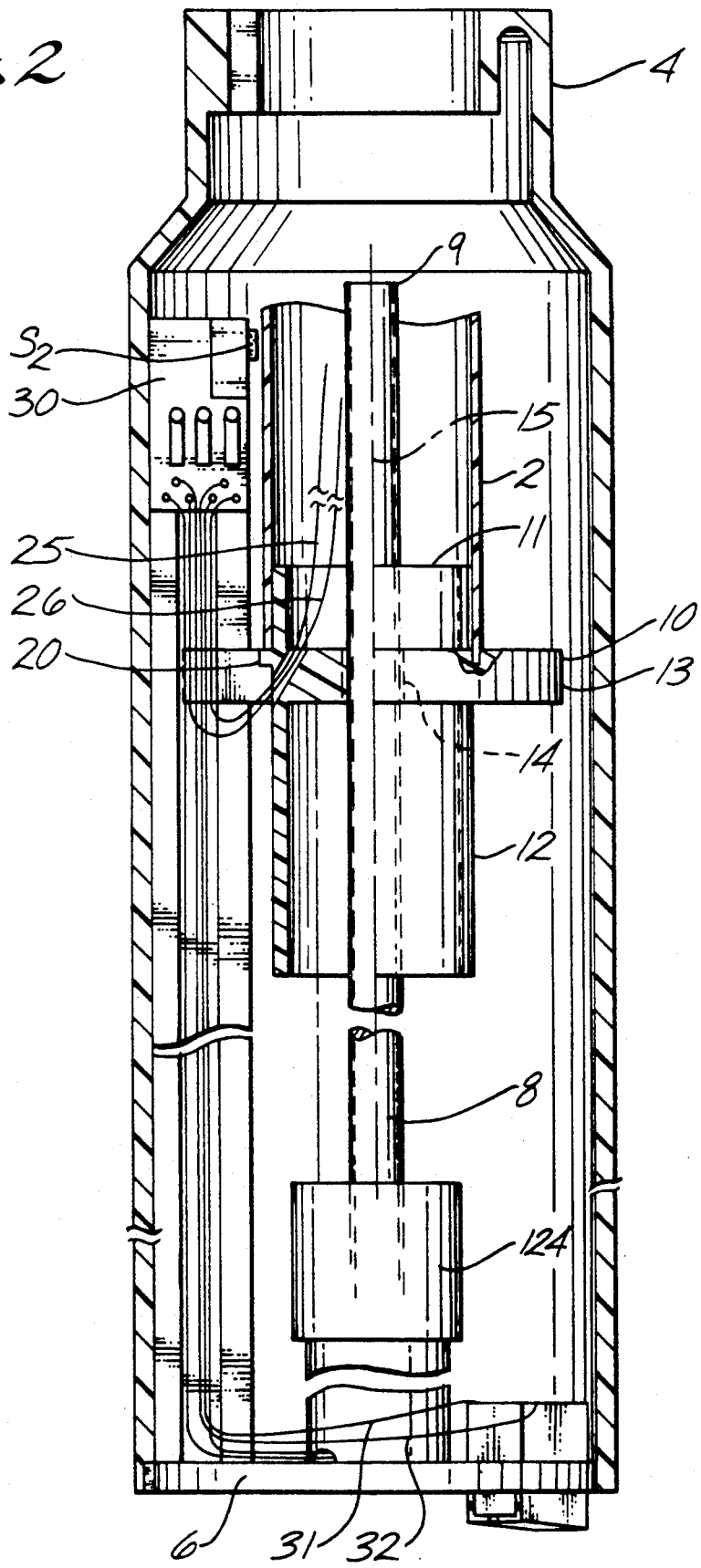
FIG. 2 is a partial cross-section of the retractable lighting system housing.

In FIG. 2, carriage member 10 is shown in a partially extended position near its upper limit of axial travel. Extension member 2 is carried by carriage member 10 and is fully extended above ground level when carriage member 10 has reached its upper limit of axial travel along threaded drive member 8. When extension member 10 is fully extended from the housing, finger or tab 20 which projects radially from carriage member 10 as shown in FIG. 2 will at the upper limit of travel of extension member 2 trip limit switch S2 into the up/stop position. Referring to the Driver Circuit demonstrated in FIG. 4, this opens the circuit containing diode D4 and closes the circuit containing diode D3. Diode D3 interrupts the flow of current and thereby shuts off motor 124. In the up/stop position, the lighting system electronic circuit which is hereafter described permits a current to continue to flow to light L1 such that L1 remains illuminated While the motor 124 is deactivated. Retraction occurs when the photo-electric cell resistance decreases sufficiently which causes an appropriate electrical signal from logic circuit 118 to reverse the polarity on motor 124 thereby retracting extension member 2 into the housing of light fixture 1. When extension member 2 is fully retracted second finger or tab 21 trips switch S2 to the down/stop position. This opens the circuit containing diode D3 and closes the circuit containing diode D4. Current flow is interrupted by diode D4 which thereby turns off motor 124 and the light L1.

The light L1 is illustrated in an exploded partial cross-sectional view of the illuminating and reflecting end of extension member 2. As can be seen in FIG. 5, a conical reflector 22 is utilized to reflect the light emitted from light L1 through the circular clear plastic lens 23. Part of the reflected light from cone reflector 22 is directed toward conical surface 24 which also reflects light through the circular lens 23. As can be seen in FIGS. 1 and 2, a pair of electrical wire conductors 25 and 26 which are in electrical communication with light L1 extend through oblique bore 27 of carriage member 10 and connect to printed circuit board 30. Current is provided to input circuit board 30 by electrical wires 31 and 32 which are connected to the relay poles 1 and 4 as can more clearly be seen on FIG. 4.

Figure 4:
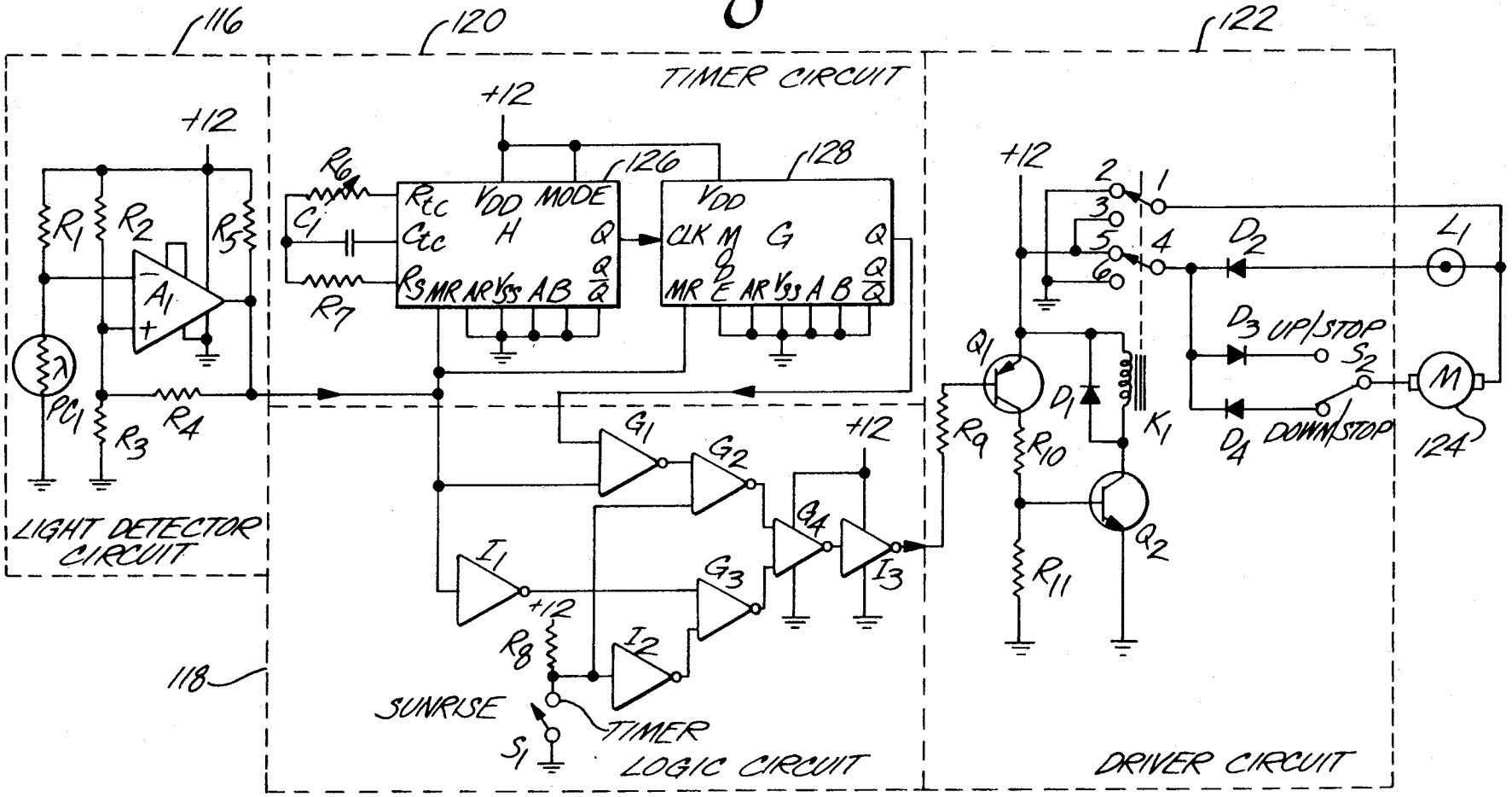
FIG. 4 is a schematic diagram of the circuit for operating the retractable lighting system.
Figure 5:
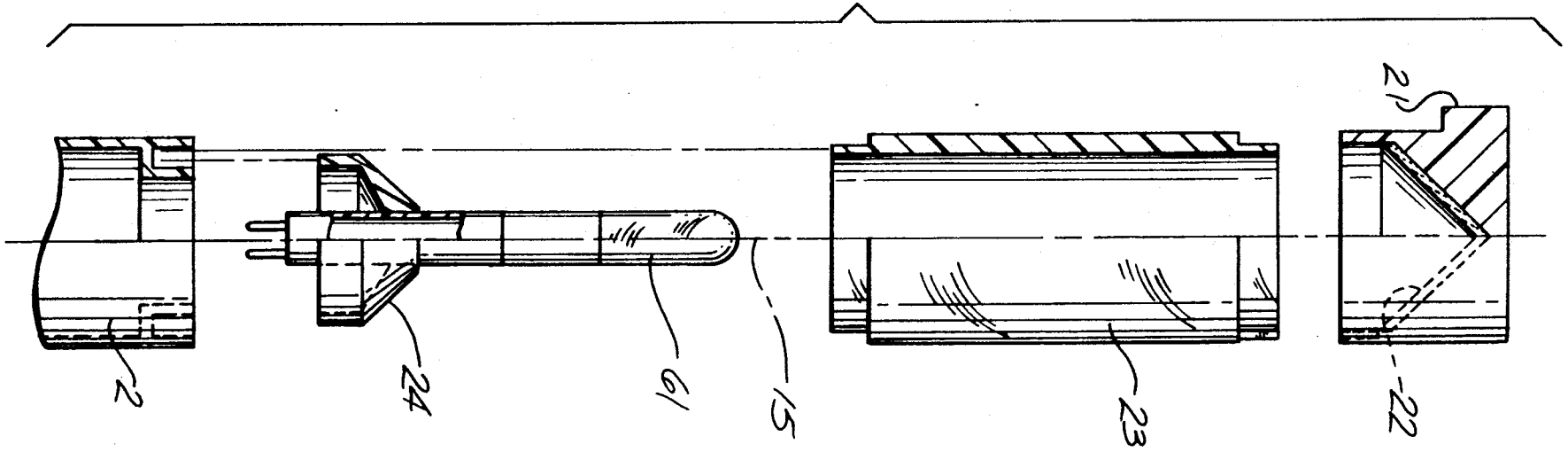
FIG. 5 is an exploded partial cross-sectional view of the extension member of the light fixture illustrating the light bulb and reflectors.

The electrical circuit of circuit board 30 is schematically shown in FIG. 4. As can be seen circuit board 30 incorporates diodes D2, D3, D4, and limit switch S2.

Figure 3:
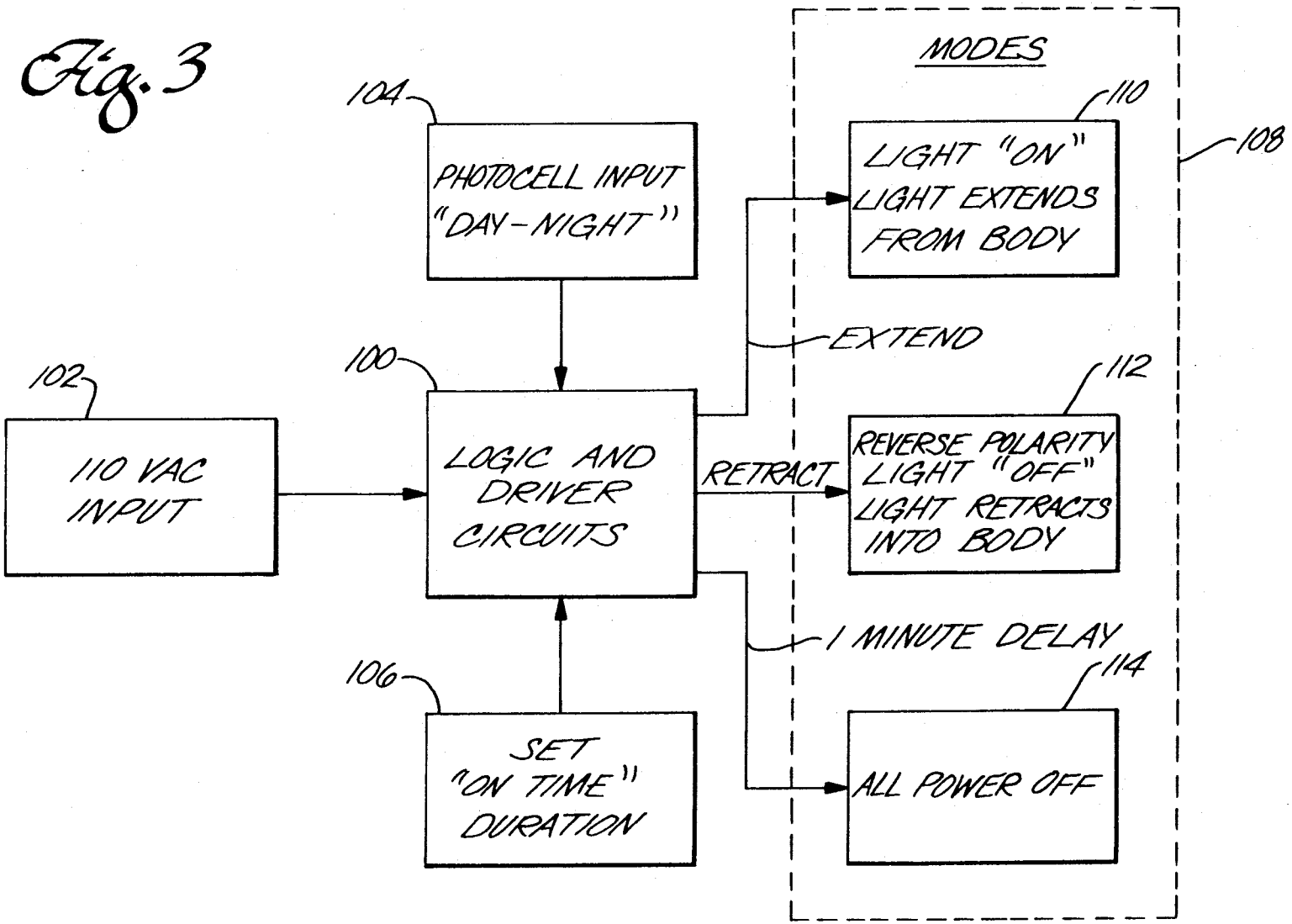
FIG. 3 is a block diagram illustrating the modes of operation of the retractable lighting system.

A block diagram illustrating the modes of operation of the retractable lighting system is shown in FIG. 3. The center or control of this circuit is the logic and drive circuits 100 that receive inputs from the DC power supply 102, light detecting circuit 104 and timer circuit 106. DC power supply 102 is powered by 110 volt AC input which is rectified for a 12 volt output for the various solid state circuits. Light detecting circuit 104 provides an output to the logic and driver circuits indicating if it is daytime or nighttime. Timer circuit 106 allows the user to select a shorter time than sunset to sunrise if desired as will be described in greater detail hereafter.

The modes of operation are indicated in block 108. In the mode indicated by block 110 the light is extended and on from sunset to sunrise or for a period of time selected by the potentiometer timer circuit 106. Block 112 indicates the retraction of the lighting system with the light off during daylight hours. Block 114 indicates the condition when all power is off after a one minute delay during daylight hours.

FIG. 4 is a schematic diagram of the circuit for operating the retractable lighting system. The circuit is comprised of light detector circuit 116, logic circuit 118, timer circuit 120, and driver circuit 122 for driving motor 124 and turning light L1 on on or off. Light detecting circuit 116 is comprised of photocell PC1 and amplifier A1. Photocell PC1 has low resistance during daylight hours causing the output from light detecting circuit to go high. At sunset when it becomes dark enough photocell PC1 resistance rises causing the output of amplifier A1 to change to a lower level output. The output of light detector circuit is connected to logic circuit 118 and timer 120. Light detector circuit resets timer circuit 120 and also provides a signal to the logic circuit to control operation of driver circuit 122.

The on and off time of the system is controlled by light detector circuit 116 alone or in combination with timer circuit 120 as selected by switch S1 in logic circuit 118. Switch S1 is shown in the position for the system to operate from sunset to sunrise with the light L1 on. A low level output from light detector circuit 116 with switch S1 in the position shown provides an output through NOR gates G1, G2, and G4 and inverter I3 to resistor R9 of driver circuit 122 turning transistors Q1 and Q2 on to activate relay K1 shown in the normally closed position with the system retracted and light L1 off. When transistor Q1 turns on, relay K1 pulls wiper contacts 1 and 4 from contacts 2 and 5 switching them to contacts 3 and 6. This applies power to motor 124 through contact 1 of relay K1 and switch S2, which is shown in the down/stop mode, and diode D4 to ground. Power is also simultaneously supplied through the same path to light L1, diode D2 to ground causing light L1 to come on and motor 124 to start extending extension member 2. When extension member 2 is fully extended, finger or tab 20 on carriage member 10 activates limit switch S2 to switch from down/stop to the up/stop position shutting off the motor and leaving light L1 illuminated. Limit switch S2 acts to stop operation of the motor and thereby prepares the circuit for reverse operation of the motor. Light L1 remains on so long as it is dark and the resistance of photocell PC1 in light detector circuit 116 remains high providing a low level output from the light detector circuit.

At sunrise as light strikes photocell PC1, the resistance decreases and the output level from light detector circuit 116 goes high changing the output of logic circuit NOR gates G1, G2, G4 and inverting buffer I3 to a high level turning off transistors Q1 and Q2 thereby releasing relay K1 and allowing the relay contacts to switch to the normally closed positions shown. Reverse polarity power is now applied to motor 124 through relay pole 4, diode D3 and switch S2 which is now in the up/stop position. When extension member 2 is retracted, second finger or tab 21 which extends radially from extension member 2 will operate limit switch S2 switching it to the down/stop position. This occurs when extension member 2 is fully retracted. Current flow is interrupted to L1 and the light therefore goes out. Thus, the system shown can fully control and reverse the operation for extending or retracting the lighting system and turning the light L1 on or off.

Timer circuit 120 is comprised of a pair of cascaded timers 126 and 128 which can be model 4541 timers or the like. The use of two timers permits calibration of timer control potentiometer R6 and increases the timing capacity. Timer circuit comes into operation whenever timing control switch S1 is switched to the timer position. With switch S1 closed or in the timer position, the on time of light L1 is controlled by timer circuit 120. The length of time the light L1 is on and the system is extended is determined by adjustment of potentiometer R6. This circuit is used if it is desired to have the light on only for a few hours. Timer circuit control is provided through inverting buffers I1 and I2 and NOR gates G1, G2, G3 and G4, in conjunction with timing switch S1 and resistor R8. With switch S1 closed and potentiometer R6 adjusted for the length of time desired, NOR gate G1 receives signals from both the light detector circuit and timing circuit 120. Invertors I1 and I2 and NOR gate G3 also provide an input to NOR gate G4 to provide the proper logic for operation with the timing circuit. At sunset timer circuit 120 activates NOR gates G1, G2 and G4 in conjunction with buffer inverts I1 and I2 and NOR gate G3; they provide an input to inverter buffer I3 to produce an output that activates resistors Q1 and Q2 turning relay K1 on activating the system. When timers 126 and 128 reach the length of time set by potentiometer R6, an output is provided to gate G1 which in combination with gates G2 and G4 reverses the output of inverter buffer I3 thereby shutting off transistors Q1 and Q2 and relay K1. Relay K1 then returns to its normally closed position shown. This turns off the light, starts the motor in the reverse direction retracting the extension member. Gates G1 through gates G4 are preferably quad/two input NOR gates such as a model 4001. Inverters I1, I2 and I3 can be provided by a model 4049 hex buffer.

While I have shown and described a certain embodiment of the present retractable lighting system, it is to be understood that it is subject to many modifications without departing from the spirit and scope of the claims recited herein.

What is claimed is:

1. A lighting system for extending and retracting a light comprising:

(a) a housing having an axis of extension;

(b) a carriage carried by said housing and adapted for axial movement relative to said housing where said carriage is so constructed and adapted to permit an electrical current to be supplied to said light;

(c) motor means carried by said housing and adapted for connection to said carriage for axially extending and retracting said carriage;

(d) reversible drive means for reversibly driving said motor means and turning said light on when said carriage is sufficiently extended and off when said carriage is sufficiently retracted;

(e) a two-position limit switch carried by said housing and in electrical communication with said motor means, said limit switch having a directionally reversible actuator responsive to a tripping force for moving said limit switch from a first position to a second position when said carriage is extended and from said second position to said first position when said carriage is retracted; and (f) interrupting means for interrupting current flow to said motor means when said two-position limit switch is moved from said first position to said second position or from said second position to said first position.

2. The lighting system according to claim 1 wherein said reversible drive means comprises relay means, switching circuit means for activating said relay, and polarity reversing means for reversing the polarity on said motor means when said carriage is sufficiently extended or retracted.

3. The lighting system according to claim 2 wherein said switching means comprises light detecting circuit means, logic circuit means and solid state switching means.

4. The lighting system according to claim 3 wherein said logic means turns said solid state switching means on when said light detecting means detects no light and off when said light detecting circuit means detects light.

5. The lighting system according to claim 3 further comprising timer circuit means connected to said logic circuit for retracting said carriage and turning said light off after a preselected period of time.

6. The lighting system according to claim 5 wherein the on time period determined by said timer circuit means is adjustable.

7. The lighting system according to claim 5 further comprising a means for enabling or disabling said timer circuit means.

8. The lighting system according to claim 6 wherein said means for enabling or disabling said timer circuit means comprises a switch in said logic circuit means for changing logic circuit means output to turn the solid state switching circuit off in response to the output of said timer circuit means.

9. The lighting system according to claim 7 wherein said light detecting circuit means comprises a photocell and amplifying means providing a high level output to said logic circuit means when said photocell detects light and a low level output to said logic circuit when said photocell detects no light.

10. The lighting system according to claim 2 wherein said switching circuit means comprises light detecting circuit means, logic circuit means and solid state switching current means.

11. The lighting system according to claim 9 wherein said logic circuit means turns said solid state switching means on when said light detecting means indicates an absence of light and off when said light detecting circuit means detects light.

12. A light fixture device for extending and retracting a light comprising:

(a) a housing having an axis of extension;

(b) a carriage carried by said housing and adapted for axial movement relative to said housing where said carriage is so constructed and adapted to permit an electrical current to be supplied to said light;

(c) motor means carried by said housing and adapted for connection to said carriage for axially extending and retracting said carriage;

(d) a two-position limit switch associated with said housing and in electrical communication with said motor means said two-position limit switch having a directionally reversible actuator responsive to a tripping force for moving said limit switch from a first position to a second position when said carriage is extended and from said second position to said first position when said carriage is retracted;

(e) tripping means carried by said carriage for tripping said directionally reversible actuator upon sufficient axial extension of said carriage and for tripping said directionally reversible actuator upon sufficient axial retraction of said carriage; and (f) interrupting means for interrupting current flow to said motor means when said two-position limit switch is moved from said first position to said second position or from said second position to said first position.

13. The light fixture device recited in claim 12 wherein said carriage comprises a carriage member and an axially extending extension member.

14. The light fixture device recited in claim 13 wherein said motor means comprises a direct current motor and a drive member coupled to said direct current motor and engaging said carriage member.

15. The light fixture device recited in claim 14 wherein said tripping means comprises a first finger extending radially from said extension member for moving said limit switch from said first position to said second position upon sufficient axial extension of said extension member and a second finger axially removed from said first finger and extending radially from said extension member for moving said limit switch from said second position to said first position upon sufficient axial retraction of said extension member.

16. A lighting system for extending and retracting a light comprising:

(a) a body so constructed and adapted to permit and electrical current to be supplied to said light;

(b) a motor for extending and retracting said body; and, (c) reversible drive means for reversibly driving said motor and turning said light on when said body is extended and off when said body is retracted.

(d) a two-position limit switch carried by said body and in electrical communication with said motor means, said two-position limit switch having a directionally reversible actuator responsive to a tripping force for moving said limit switch from a first position to a second position when said body is extended and from said second position to said first position when said body is retracted;

(e) interrupting means for interrupting current flow to said motor means when said two-position limit switch is moved from said first position to said second position or from said second position to said first position.

17. The lighting system according to claim 16 in which said reversible drive means comprises relay means; switching circuit means for activating said relay; and polarity reversing means for reversing the polarity on said motor when said body is extended or retracted.

18. The lighting system according to claim 17 in which said switching means comprises, light detecting circuit means, logic circuit means and solid state switching means.

19. The lighting system according to claim 18 in which said logic circuit means turns said solid state switching means on when said light detecting means detects no light and off when said light detecting circuit means detects light.

20. The lighting system according to claim 18 including timer means connected to said logic circuit means for retracting said body and turning said light off after a preselected period of time.

21. The lighting system according to claim 19 in which the on time period determined by said timer circuit means is adjustable.

22. The lighting system according to claim 20 including means for enabling or disabling said timer circuit means.

23. The lighting system according to claim 22 in which said means for enabling or disabling said timer circuit means comprises a switch in said logic circuit means for changing the logic circuit means output to turn the solid state switching means off in response to the output of said timer circuit means.

24. The lighting system according to claim 22 in which said light detecting circuit means comprises a photocell and amplifying means providing a high level of output to said logic circuit means when said photocell detects light and a low level output to said logic circuit means when said photocell detects no light.

25. The lighting system according to claim 17 in which said switching current means comprises light detecting circuit means, logic circuit means and solid state switching means.

26. The lighting system according to claim 24 in which said logic circuit means turns said solid state switching means on when said light detecting circuit means detects no light and off when said light detecting means detects light.

* * * * *